US009238519B2

(12) United States Patent
Zimmel

(10) Patent No.: US 9,238,519 B2
(45) Date of Patent: Jan. 19, 2016

(54) UNITARY LANYARD AND BASE FOR ELECTRONIC SURVEILLANCE TAG

(71) Applicant: Louis J. Zimmel, Hinsdale, IL (US)

(72) Inventor: Louis J. Zimmel, Hinsdale, IL (US)

( * ) Notice: Subject to any disclaimer, the term of this patent is extended or adjusted under 35 U.S.C. 154(b) by 300 days.

(21) Appl. No.: 13/792,747

(22) Filed: Mar. 11, 2013

(65) Prior Publication Data

US 2013/0247337 A1 Sep. 26, 2013

Related U.S. Application Data

(60) Provisional application No. 61/610,593, filed on Mar. 14, 2012.

(51) Int. Cl.

| | |
|---|---|
| ***G08B 13/14*** | (2006.01) |
| ***B65C 7/00*** | (2006.01) |
| ***E05B 73/00*** | (2006.01) |

(52) U.S. Cl.

CPC ..... *B65C 7/001* (2013.01); *E05B 73/0017* (2013.01); *G08B 13/1445* (2013.01); *Y10T 24/3481* (2015.01); *Y10T 24/3497* (2015.01)

(58) Field of Classification Search

CPC combination set(s) only.
See application file for complete search history.

(56) References Cited

U.S. PATENT DOCUMENTS

| | | | | |
|---|---|---|---|---|
| 3,932,918 | A | 1/1976 | Paskert | |
| 3,942,829 | A | 3/1976 | Humble | |
| 4,221,025 | A | 9/1980 | Martens | |
| 4,588,218 | A | 5/1986 | Guiler | |
| 7,084,766 | B2 | 8/2006 | Sayegh | |
| 7,084,776 | B2 | 8/2006 | Sayegh et al. | |
| D556,072 | S | 11/2007 | Fawcett et al. | |
| 7,342,495 | B2 | 3/2008 | Sayegh et al. | |
| D578,030 | S | 10/2008 | Yang | |
| 7,474,209 | B2 | 1/2009 | Marsilio | |
| D599,242 | S | 9/2009 | Yang | |
| D628,505 | S | 12/2010 | Sayegh | |
| 8,408,472 | B2 | 4/2013 | Yang | |
| 8,482,414 | B2 | 7/2013 | Leyden | |
| 2005/0270155 | A1* | 12/2005 | Sayegh | 340/572.1 |
| 2011/0018716 | A1 | 1/2011 | Piccoli | |

* cited by examiner

*Primary Examiner* — Brian Zimmerman
*Assistant Examiner* — Cal Eustaquio
(74) *Attorney, Agent, or Firm* — James N. Videbeck

(57) ABSTRACT

A mounting disk, lanyard and distal tip are formed as a unitary member and may be utilized with a plurality of differing EAS tags to provide effective theft protection devices.

20 Claims, 3 Drawing Sheets

UNITARY LANYARD AND BASE FOR ELECTRONIC SURVEILLANCE TAG

This application claims priority of Provisional Application 61/610,593 filed Mar. 14, 2012, the contents of which are incorporated by reference, to the extent allowed by law.

BACKGROUND OF THE INVENTION

Retail stores utilize electronic article surveillance (EAS) tags, especially in connection with clothing, to prevent theft of such items. A tag will generally be a rectangular structure on the order of ⅝ inch in width and 1½ inch in length with varying thickness, including a flat top side having a pin receiving aperture therein. For clothing and other fabric material items, a pin member, having a circular disk shaped top and a pin extending perpendicularly from the center thereof, is positioned through the fabric and into the aperture or hole in the tag to maintain the EAS structure on a consumer item to be sold. FIG. 3 of U.S. Pat. No. 7,084,766 discloses such a circular disk with pin extending therefrom that is meant to be positioned in the aperture or hole on the top of a tag 22. Such a tag assembly is not convenient to utilize for articles of clothing such as leather or for handbags, purses, or the like generally made of other than a one layer of woven fabric.

Another type of theft deterrent device includes a lanyard that extends from the tag so as to be positioned around a handbag strap or through a button hole in an item wherein the prior mentioned combined disk and pin is not appropriate. U.S. Pat. No. 7,342,495 discloses an EAS tag that has a lanyard fixedly extending therefrom including a pin at the end that is mountable in an aperture or hole in the top of the lanyard. However, it should be noted that there are over approximately 200 different styles and shapes of EAS tags currently on the market and the lanyard shown only works with the one tag disclosed therein. Additionally, it would be expected that improvements in such EAS tags may be made in the future to provide for more elaborate electronic circuitry therein.

A need has developed for a simplified lanyard/pin/base device that can be utilized with a plurality of the EAS tags now available on the market and which may be available for use with EAS tags developed in the future.

SUMMARY OF THE INVENTION

An integrally formed mounting disk and lanyard for selectively attaching same to an (EAS) tag, said integral disk and lanyard comprising: a disk of plastic or other suitable material forming a base smaller in height than in a generally symmetrical length and width, said disk including an aperture vertically centrally therethrough. An elongate bodied lanyard is mounted on said disk at one end thereof and is securely attached, preferably by welding, soldering or the like to a rigid pin on an opposing end thereof. The lanyard is bendable with the pin end being insertable in and through the aperture in the disk. The length of the pin is sufficient to extend beyond the height of the disk aperture for being selectably retainable in an EAS tag.

BRIEF DESCRIPTION OF THE DRAWINGS

The features of the present invention which are believed to be novel are set forth with particularity in the attached claims. The invention may best be understood by reference to the following description taken in conjunction with the accompanying drawings in which like numerals refer to like parts and in which:

DETAILED DESCRIPTION OF THE PREFERRED EMBODIMENT

Figure 1:
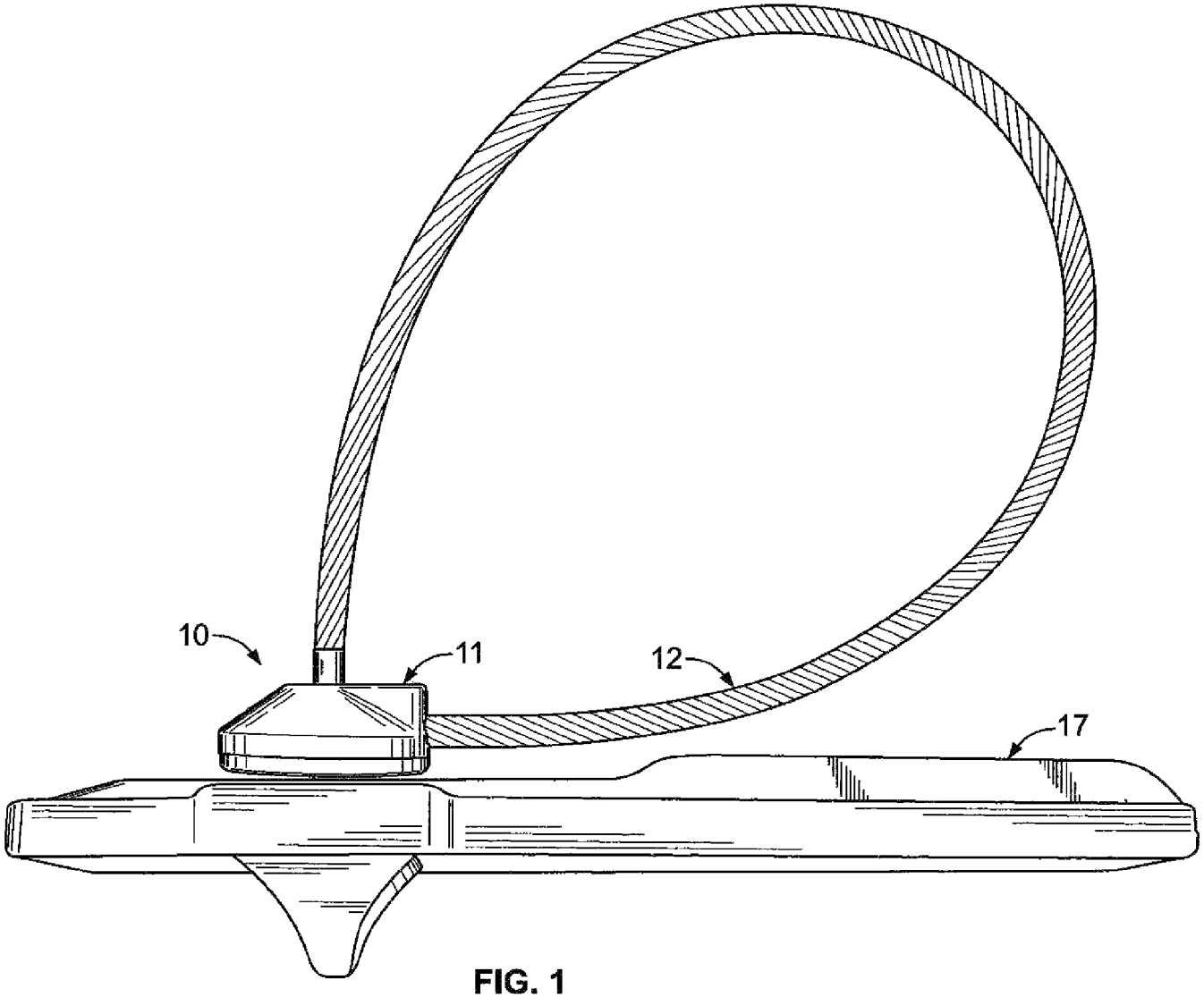
FIG. 1 is a side elevational view of a combination disk and lanyard/pin constructed in accordance with the present invention mounted on an electronic article surveillance tag.
Figure 2:
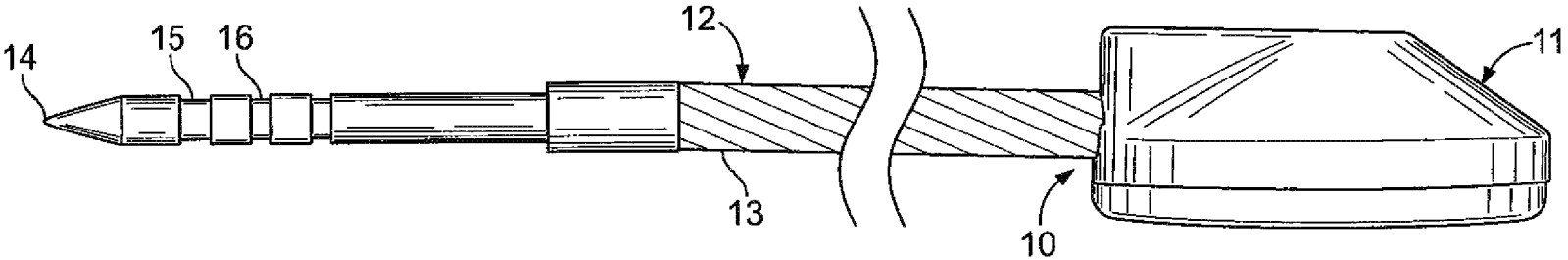
FIG. 2 is a side elevational view of the disk and lanyard/pin shown in FIG. 1.

Referring to FIGS. 1 and 2, in a preferred embodiment 10 of the present invention, the combination lanyard 12 and base 11 of the present invention is comprised of an elongated lanyard 12 having a rectangular mountable end (not shown), a plastic covered wire central portion 13 and a pointed tip 14 at its opposing end with annular indents 15-16 adjacent the pointed tip 14 for being captured in the mounting aperture or hole (not shown) of a separate electronic article surveillance (EAS) tag 17.

Figure 4:
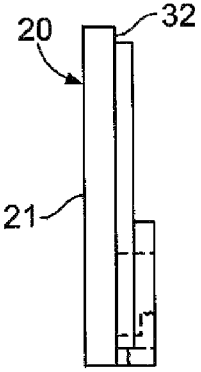
FIG. 4 is a side elevational view of the base member shown in FIG. 3.
Figure 3:
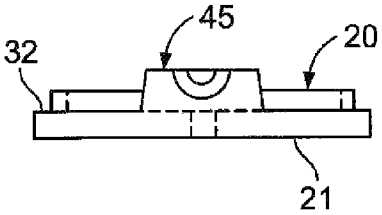
FIG. 3 is an end elevational view of the base member of the disk shown in FIG. 1.
Figure 8:
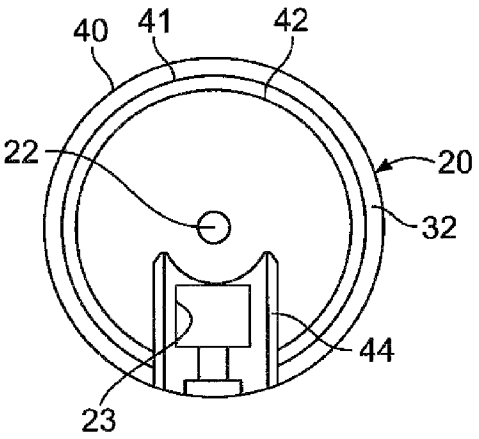
FIG. 8 is a top plan view of the cover.

Referring to FIGS. 3, 4 and 8, in the present preferred embodiment, the disk 11 portion of the invention includes a generally cylindrical base member 20 having a flat plain bottom 21 with an aperture 22 centrally perpendicularly therethrough. Adjacent the central aperture toward one part of the periphery is a female socket 23 shaped to receive the preferably generally rectangular, but also may be cylindrical, mounting end of the lanyard 12.

Figure 5:
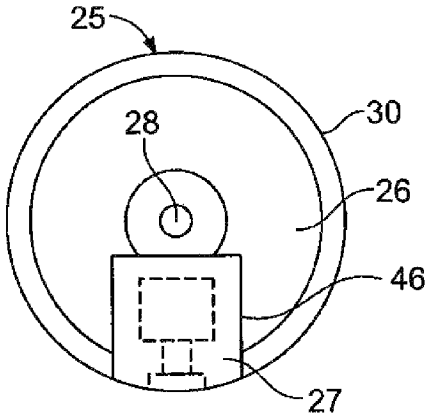
FIG. 5 is a top plan view of a cover member for the disk shown in FIG. 1.
Figure 7:
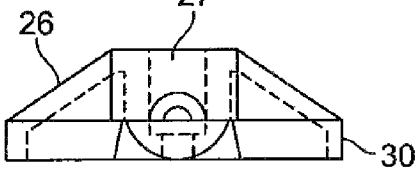
FIG. 7 is a side elevational view.
Figure 6:
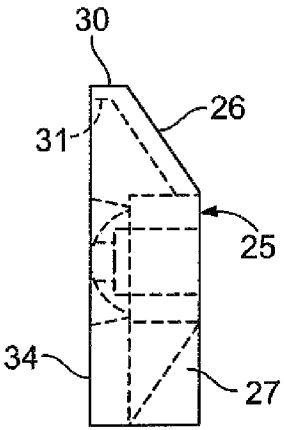
FIG. 6 is a side elevational view of the cover member of FIG. 5.

Referring to FIGS. 5, 6 and 7 cover 25 for the disk 11 is also circular in outline and has a generally frustoconical shape 26 with the exception of the socket cover portion 27 that is the rectangular portion extending from adjacent the central aperture 28 therein to the periphery 30 of the disk 11 which socket cover 27 is generally rectangularly shaped to cover up and close the lanyard mounting portion in the base 20. The bottom of the cover further includes an annular rim which extends around the base of the cover with the exception of the lanyard mounting portion.

This annular ridge 31 is adapted to fit over a similar annular ridge 32 in the top of the base 20. With the lanyard mounting portion (not shown) fitted in the recess 23 in the base, the cover 25 may be positioned thereover to securely mount the lanyard therein and cover it over. Also, the annular flat portion 32 of the cover 25 sits in and is retained by the annular rim 31 in the top portion of the base 20. Once the cover 25 has been positioned on the combination of the lanyard mounting 23 and the base 11, it may be secured thereto by an adhesive, ultrasonic welding, heat, etc. as desired to secure the three-piece assembly into a unitary structure 10.

In a preferred embodiment such as shown in FIGS. 3-8, the outer diameter of the base 40 is 20 mm, the inner diameter 41 of the rim is 14.4 mm and the top 42 of the rim for the base 20 is 10 mm in diameter. The width of the lanyard mounting portion 44 is 6.62 cm. The outer dimension of the base 40 is 20 mm and the thickness of the base is 1.5 mm. The height of the base 45 at the top of the lanyard mounting portion is 1 mm.

Further in the preferred embodiment, the cover 25 is also 20 mm in diameter at its outermost portion 30, and 7.6 mm in height. The cover portion 40 which extends over the lanyard mounting portion 44 in the base is 1.6 cm in width. The radius of the frustoconical portion 26 begins at 17.6 mm in diameter and ends at 10 mm in diameter. A preferred material for the 2 piece base shown is molded plastic. The lanyard 12 is a plastic covered metal cable, although plastic of PTFE may be substituted.

It will be understood that this unitary structure combined lanyard and pin mounting disk may be utilized with a plurality of differing electronic article surveillance (EAS) tags, both as presently available in the marketplace and as may become available in the future with advanced electronics positioned therein.

While one embodiment of the present invention has been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. An integrally formed mounting disk and lanyard for selectively attaching same to a separate (EAS) tag, said integral disk and lanyard comprises:

a disk of plastic material forming a base smaller in height than in a generally symmetrical length and width, said disk including an aperture vertically centrally therethrough, an elongate bodied lanyard mounted on said disk at one end thereof and securing a pin on the opposing end thereof, said lanyard being bendable with said pin end being insertable in and through said aperture in said disk, and a length of said pin being sufficient to extend beyond the height of said disk aperture for being selectably retainable in an EAS tag.

2. The disk and lanyard as defined in claim 1 wherein:

said disk includes a base member on which said one end of said lanyard is mounted and a cover member extending over said base and securing enclosing said lanyard mounting, and said base member, said cover member and said lanyard being joined to form a unitary member.

3. The disk and lanyard as defined in claim 1 wherein said lanyard is preferably made of metal cable and further includes:

a metal tip shaped for being selectably retainable in an EAS tag.

4. The disk and lanyard as defined in claim 2 wherein said disk is circular in outline and said cover includes a frustoconical portion.

5. The disk as defined in claim 1 wherein said cover is mounted on a ledge on said base member above a bottom of said base.

6. The disk and lanyard as defined in claim 4 wherein said cover further includes a generally rectangular lanyard mounting cover portion integrally formed at one side of said frustoconical portion.

7. The disk and lanyard as defined in claim 2 wherein said base member includes a female type lanyard mounting portion thereon.

8. This disk and lanyard as defined in claim 2 wherein said base member and said cover member each include a central aperture vertically therethrough in coaxial alignment when said cover is mounted over said base member.

9. The disk and lanyard as defined in claim 8 wherein said base member and cover apertures are sized to slidably receive said lanyard pin end therethrough.

10. An integrally formed mounting disk and lanyard for selectively attaching same to an (EAS) tag, said integral disk and lanyard comprises:

a disk of plastic material forming a base smaller in height than in a generally symmetrical length and width, said disk including an aperture vertically centrally therethrough, an elongate bodied lanyard mounted on said disk at one end thereof and securing a pin on a opposing end thereof, said lanyard being bendable with said pin end being insertable in and through said aperture in said disk, a length of said pin being sufficient to extend beyond the height of said disk aperture for being selectably retainable in an EAS tag;

said disk including a base member having a lanyard mounting at one side thereof, and on which said one end of said lanyard is mounted, a cover member extending over said base member and securely enclosing said lanyard mounting, said base member, said cover member and said lanyard being joined to form a unitary member, and a metal tip shaped for being selectably retainable in an EAS tag.

11. The disk and lanyard as defined in claim 10 wherein said disk is circular in outline, said cover includes a frustoconical portion, said cover being mounted on a ledge on said base member spatially above a bottom of said base member.

12. The disk and lanyard as defined in claim 11 wherein said cover further includes a lanyard mounting cover portion integrally formed at one side of said frustoconical portion, and said base member includes a female type lanyard mounting portion thereon.

13. The disk and lanyard as defined in claim 10 wherein said base member and said cover member each include a central aperture vertically therethrough in coaxial alignment when said cover is mounted over said base member.

14. The disk and lanyard as defined in claim 13 wherein said base member and cover apertures are sized to slidably receive said lanyard pin end therethrough.

15. The disk and lanyard as defined in claim 2 wherein said disk is generally circular in outline and said cover includes a generally vertical outer wall defining a pin mounting portion of said disk.

16. A mounting disk and lanyard comprising:

a disk of plastic material forming a base smaller in height than in a generally symmetrical length and width, said disk including a first aperture vertically centrally therethrough, an elongate bodied lanyard mounted on said disk at one end thereof and securing a pin on a opposing end thereof, said lanyard being bendable with said pin end being insertable in and through said first aperture in said disk, said disk including a base member having a lanyard mounting at one side thereof, and one which said one end of said lanyard is mounted, a cover member extending over said base member, including a second aperture aligned with said first aperture, said cover member securely enclosing said lanyard mounting, said disk being generally circular in outline and said cover including a generally vertical outer wall segment defining a pin mounting portion of said disk, a length of said pin being sufficient to extend beyond the height of said base and said cover aperture, said base member and said cover member and said lanyard being joined to form a unitary member, and a metal tip defining said pin.

17. An integrally formed mounting disk and lanyard, said integral disk and lanyard comprises:

a disk of plastic material forming a base smaller in height than in length and width, said disk including an aperture vertically centrally therethrough, an elongate bodied lanyard mounted on said disk at one end thereof and securing a pin on the opposing end thereof, said lanyard being bendable with said pin and being insertable in and through said aperture in said disk, and a length of said pin being sufficient to extend beyond the height of said disk aperture.

18. The disk and lanyard as defined in claim 17 wherein said disk is generally symmetrical in length and width.

19. The disk and lanyard as defined in claim 17 wherein at least one of said length and width of said disk become smaller toward a top of said disk.

20. The disk and lanyard as defined in claim 17 wherein said disk includes a female mounting for said one end of said lanyard.

* * * * *